US005823403A

United States Patent [19]

Schneider

[11] Patent Number: 5,823,403

[45] Date of Patent: Oct. 20, 1998

[54] HIGH THRUST DRIVE SYSTEM AND DEVICES EMPLOYING

[75] Inventor: Mark C. Schneider, Moorestown, N.J.

[73] Assignee: Albion Engineering Company, Philadelphia, Pa.

[21] Appl. No.: 783,806

[22] Filed: Jan. 16, 1997

Related U.S. Application Data

[60] Provisional application No. 60/010,143, Jan. 17, 1996.

[51] Int. Cl. [6] ..... B67D 5/42

[52] U.S. Cl. ..... 222/391; 874/141.5

[58] Field of Search ..... 222/391, 326, 222/327; 74/141.5, 167, 169

[56] References Cited

U.S. PATENT DOCUMENTS

| | | | |
|---|---|---|---|
| 2,420,203 | 5/1947 | Sherbondy | 74/169 X |
| 2,530,359 | 11/1950 | Peterson | 74/169 |
| 2,534,857 | 12/1950 | Crewe | 74/169 |
| 2,570,360 | 10/1951 | McCarroll | 74/141.5 |
| 3,069,053 | 12/1962 | Nilsson | 222/381 |
| 4,653,673 | 3/1987 | Wagner | 74/141.5 X |
| 5,390,831 | 2/1995 | Schneider . | |
| 5,501,347 | 3/1996 | Laufer et al. | 222/391 |

*Primary Examiner*—Kenneth Bomberg
*Attorney, Agent, or Firm*—Caesar, Rivise, Bernstein, Cohen & Pokotilow, Ltd.

[57] ABSTRACT

A high thrust drive system usable in a variety of devices, e.g., fluid dispensing, article clamping, article lifting and article jacking, includes a driving rod member, an actuating member movable through a driving stroke and a return stroke, and a gripping plate having a passage therein through which the driving rod extends for gripping the driving rod and moving the rod in a thrust-applying direction during the driving stroke of the actuating member. The actuating member imposes a high thrust on the driving member through the gripping plate during the driving stroke, and the gripping plate imposes a torque on the driving rod in a first rotational direction as the actuating member is moved through the driving stroke. A recoil plate is oriented to grip the driving rod during the return stroke of the actuating member and impose a torque on the driving rod in the same first rotational direction as the gripping plate to preclude movement of the driving rod in a direction opposite the thrust-applying direction, whereby applying a torque on the driving rod in the same rotational direction during the driving and return strokes of the actuating member imparts a smooth, linear motion to the driving rod as the driving rod is moved in the thrust-applying direction.

8 Claims, 3 Drawing Sheets

FIG. 3
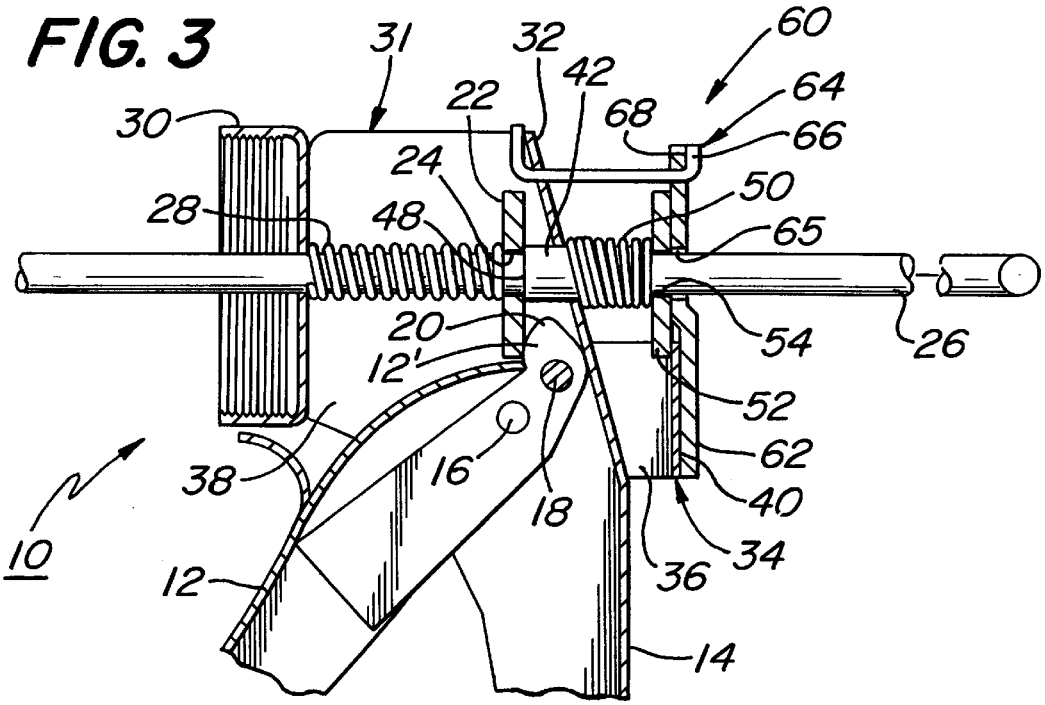
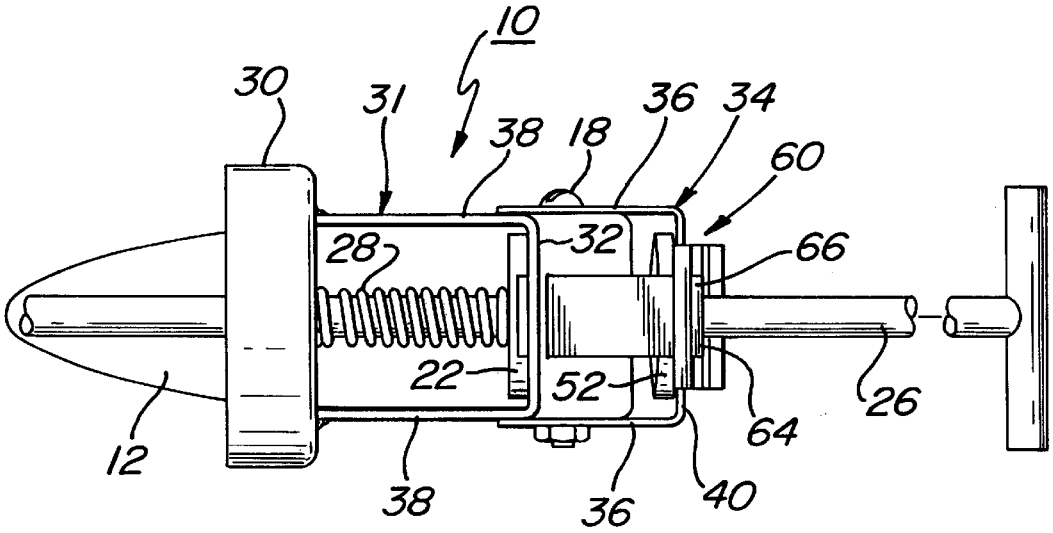
FIG. 4

HIGH THRUST DRIVE SYSTEM AND DEVICES EMPLOYING

RELATED APPLICATIONS

This is a utility application based upon provisional patent application Ser. No. 60/010,143, filed Jan. 17, 1996, entitled Dispensing Devices for High Viscosity Compositions. Applicant hereby incorporates the entire subject matter of the '143 provisional application into this utility application and also claims the benefit of the filing date of the '143 provisional application for this utility application.

BACKGROUND OF THE INVENTION

This invention relates to a unique high thrust drive system usable in different types of devices for a variety of applications, e.g., clamping, jacking, lifting and fluid dispensing. In a particularly preferred application the high thrust drive system is employed in a dispensing device for high viscosity fluids, such as a caulking gun.

In caulking guns and other devices for dispensing high viscosity fluids it is well known to employ a piston assembly that includes a piston rod passing through a passage in a gripping plate that, in turn, is controlled by the operation of a trigger to grip and move the piston rod in a forward, linear direction for dispensing the caulking composition, or other high viscosity fluid. The gripping plate commonly is canted in a clockwise direction during the driving stroke to also impose an upward force and clockwise rotational torque on the piston rod as the piston rod is being moved to dispense a high viscosity fluid.

These prior art guns also include a recoil plate for preventing undesired retraction of the piston assembly when the trigger is released after a dispensing stroke. As is well known, such a recoil plate is commonly located upstream of the gripping plate and includes a passage therethrough in axial alignment with the passage through the gripping plate for receiving the piston rod of the piston assembly therethrough. The recoil plate normally is canted relative to the piston rod in a counter-clockwise direction to cause an edge of the surface defining the passage through the recoil plate to engage the piston rod after a dispensing stroke to prevent the rod from being inadvertently retracted. Specifically, this engagement of the recoil plate with the piston rod normally imposes a downward force and counterclockwise rotational torque on the piston rod when the trigger is released after a driving stroke to thereby preclude the piston rod from moving in a rearward direction.

Thus, in the prior art devices known to applicant, the piston rod is alternately subjected to an upward force and clockwise rotational torque by the gripping plate during the fluid dispensing stroke and then to a downward force and counterclockwise rotation torque by the recoil plate when the trigger is released after a dispensing stroke. These alternating clockwise and counterclockwise torques preclude a smooth linear motion of the piston rod during the dispensing strokes of the device, and also impose undesired stresses on the system.

In order to retract the piston rod, which is required, for example, when a canister containing the fluid to be dispensed is to be inserted into the forward or distal end of the dispenser after a previous canister has been emptied, the recoil plate must be moved into a neutral, or non-piston-rod-engaging condition, to permit the piston rod to be manually retracted. A typical prior art dispensing device including the features described above is disclosed in U.S. Pat. No. 5,390,831, issued to Mark C. Schneider on Feb. 21, 1995, and assigned to Albion Engineering Company. The entire subject matter of this '831 patent is incorporated by reference herein, and a number of features disclosed in the '831 patent can be employed in the dispensing device of this invention.

In the device disclosed in the '831 patent the recoil plate is in the form of a rear dog 64 that is mounted for pivotal movement about a pivot axial 76. By pivoting the dog 64 in a clockwise direction into a neutral position, as viewed in FIG. 1 of the '831 patent, through finger pressure applied to finger-gripping extension 66, the gripping action of the dog on the piston rod 24 is released, thereby permitting the piston rod to be retracted.

Applicant has determined that in many cases it is difficult to bias the recoil plate, or gripping dog, into a neutral position in a controlled manner to permit the piston rod to be retracted. In accordance with the invention of this application a mechanical advantage is created in a unique manner by constructing the recoil system of a pivotally mounted, finger-actuated recoil lever in combination with a separate recoil plate to provide a double lever action, as will be described in detail hereinafter.

SUMMARY OF THE INVENTION

A high thrust drive system in accordance with this invention includes a driving rod member, an actuating member movable through a driving stroke and a return stroke, and a gripping plate having a passage therein through which the driving rod extends for gripping the driving rod and moving the rod in a thrust-applying direction during the driving stroke of the actuating member. The actuating member imposes a high thrust on the driving member through the gripping plate during the driving stroke, said gripping plate imposes a torque on said driving rod in a first rotational direction as said actuating member is moved through the driving stroke. A recoil plate is oriented to grip the driving rod during the return stroke of the actuating member and impose a torque on said driving rod in said first rotational direction to preclude movement of said driving rod in a direction opposite said thrust-applying direction, whereby applying a torque on the driving rod in the same rotational direction during the driving and return strokes of the actuating member imparts a smooth, linear motion to the driving rod as said driving rod is moved in said thrust-applying direction.

In a preferred embodiment of the invention, the recoil plate of the high thrust drive system has a passage through which said driving rod extends.

In accordance the preferred embodiment of this invention the gripping plate is canted in a first direction relative to said driving rod during the driving stroke of said actuating member and the recoil plate normally is canted in the same first direction during both the driving and return strokes of said actuating member.

In the preferred embodiment of this invention the high thrust drive system includes a lever engageable with the recoil plate and is pivotally mounted for movement against said recoil plate to pivot said recoil plate into an orientation for releasing the grip of said recoil plate from said driving rod to permit said driving rod to be moved manually in a direction opposite the thrust-applying direction.

Most preferably the recoil plate of the high thrust drive system engages a wall member at a location on one side of the passage through the recoil plate when said recoil plate normally is canted in the first direction and wherein said lever is engageable with said recoil plate at a location on the opposite side of said passage through said recoil plate for pivoting said recoil plate into an orientation for releasing the grip of said recoil plate from said driving rod to permit said driving rod to be moved manually in a direction opposite the thrust-applying direction.

In accordance with a preferred form of this invention the high thrust drive system is employed as part of a dispensing device for fluids, said dispensing device including an actuating member in the form of a trigger movable through a dispensing stroke and a return stroke, a driving rod in the form of a piston rod, and a gripping plate having a passage therein through which the piston rod extends for gripping the piston rod and moving said piston rod in a fluid dispensing direction during the dispensing stroke of the trigger. The gripping plate imposes a torque on the piston rod in a first rotational direction during the dispensing stroke of the trigger, and a recoil plate for gripping the piston rod during the return stroke of the trigger is oriented to impose a torque on said piston rod in said first rotational direction to preclude movement of said piston rod in a linear direction opposite said fluid dispensing direction. By applying a torque on the piston rod in the same rotational direction during both the dispensing and return strokes of the trigger a smooth, linear motion is imparted to the piston rod as said piston rod is moved in the fluid dispensing direction.

In the preferred embodiment of this invention the recoil plate of the dispensing device plate has a passage through which said piston rod extends, and the recoil plate is normally canted to cause surfaces adjacent the passage to engage the piston rod for preventing movement of the piston rod in a direction opposite to the dispensing stroke while still permitting movement of the piston rod in the fluid dispensing direction.

Most preferably the gripping plate is canted in a first direction relative to piston rod during the dispensing stroke of the trigger and the recoil plate normally is canted in said first direction during both the dispensing and the return strokes of said trigger.

In the most preferred embodiment of this invention the dispensing device includes a lever engageable with the recoil plate and that lever is pivotally mounted for movement against the recoil plate to pivot the recoil plate into an orientation for releasing the grip of said recoil plate from the piston rod to permit said piston rod to be moved manually in a direction opposite the fluid dispensing direction.

In the most preferred embodiment of the invention the recoil plate of the dispensing device engages a wall of the device at a location on one side of the passage through said recoil plate when said recoil plate normally is canted in a direction for gripping the piston rod to prevent rearward movement thereof, and a separate lever is engageable with said recoil plate at a location on the opposite side of said passage through said recoil plate for pivoting said recoil plate into an orientation for releasing the grip of said recoil plate from said piston rod to permit said piston rod to be moved manually in said rearward direction.

BRIEF DESCRIPTION OF THE DRAWINGS

The above and other objects and many attendant features of this invention will become readily appreciated as the same becomes better understood by reference to the following detailed description when considered in connection with the accompanying drawings wherein:

FIG. 3 is a fragmentary sectional view of the proximal end of the caulking gun shown in FIG. 1, but with the recoil assembly of the high thrust drive system actuated to release the gripping force on the piston rod passing therethrough; and FIG. 4 is a plan view of the proximal end of the caulking gun shown in FIG. 3.

DESCRIPTION OF THE PREFERRED EMBODIMENT OF THE INVENTION

Figure 1:
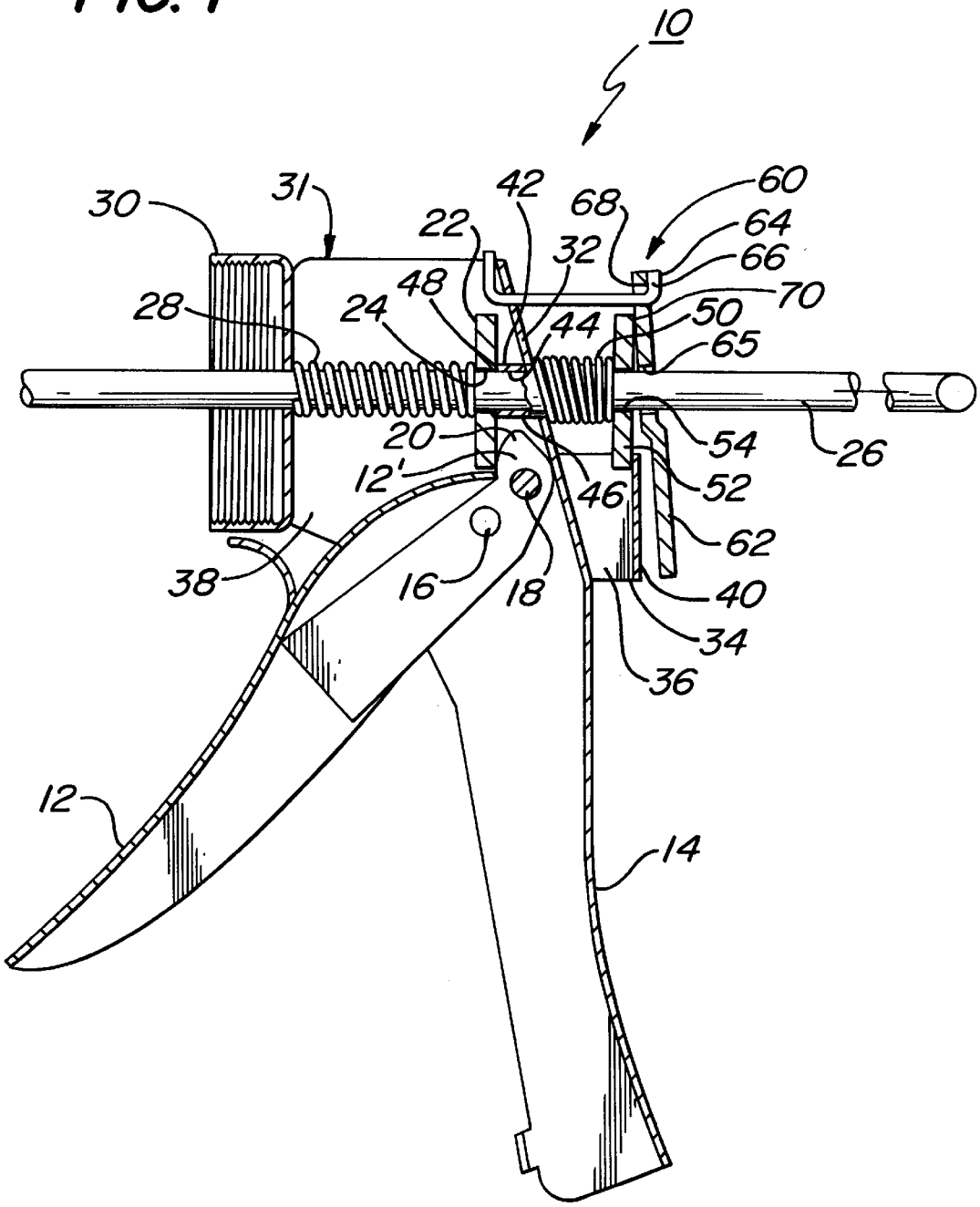
FIG. 1 is a sectional view of the proximal end of a caulking gun employing the unique high thrust drive system of the present invention, prior to actuation of the trigger for dispensing a fluid, and with a recoil assembly of the drive system being shown prior to being actuated to release the gripping force on the piston rod passing therethrough.

Referring to the Figures, the proximal, or driving end of the caulking gun 10 employing the unique high thrust drive system of this invention is shown. This driving system includes an actuating member in the form of a trigger 12 pivotally connected to a handle 14 through either a lower pivot axle 16 or an upper pivot axle 18, depending upon the desired mechanical advantage. Specifically, when the trigger 12 is connected to the handle through the pivot axle 16 the horizontal distance of travel of the upper driving end 12' of the trigger is greater than when the trigger is connected to the handle through the upper pivot axle 18, but the mechanical advantage at the driving end is lower.

The distal end of the caulking gun 10 can be of any design for retaining the fluid to be dispensed. For example, the distal end can be identical to that shown in applicant's U.S. Pat. No. 5,390,831, the subject matter of which already has been incorporated by reference herein.

The upper driving end 12' of the trigger includes a nose portion 20 that engages and drives a gripping plate 22. The gripping plate 22 includes a passage 24 through which a driving rod in the form of a piston rod 26 passes, and the gripping plate normally is maintained in a canted position for clamping onto the piston rod in a manner that permits distal movement of the gripping plate to impart a corresponding distal movement to the piston rod 26.

As is illustrated in FIG. 1, the gripping plate 22 normally is canted in a clockwise direction relative to a vertical axis normal to the longitudinal axis of the piston rod 26 about a pivot created by engagement of the lower end of the gripping plate with the nose portion 20 of the upper driving end 12' of the trigger 12. As a result of this arrangement, the gripping plate 22, in addition to applying a linear force along the longitudinal axis of the piston rod 26 during a fluid dispensing stroke of the trigger 12, also imposes an upward force on the piston rod creating a torque on the piston rod in a clockwise rotational direction, as viewed in FIGS. 1–3.

The piston rod 26 is connected to a piston head (not shown) secured to the distal end thereof in any conventional manner, for driving material out of a container (not shown) including the material to be dispensed when the piston rod is moved to the left, as viewed in FIGS. 1–4. When the trigger 12 is pivoted toward handle 14 the nose portion 20 thereof engages and moves the gripping plate 22 and the piston rod 26 clamped thereby toward the distal end of the gun to dispense material out of the container into which the piston head (not shown) attached to the piston rod 26 is moved. As explained above, this also imposes a clockwise torque on the piston rod 26 tending to bias the rod in an upward direction.

Figure 2:
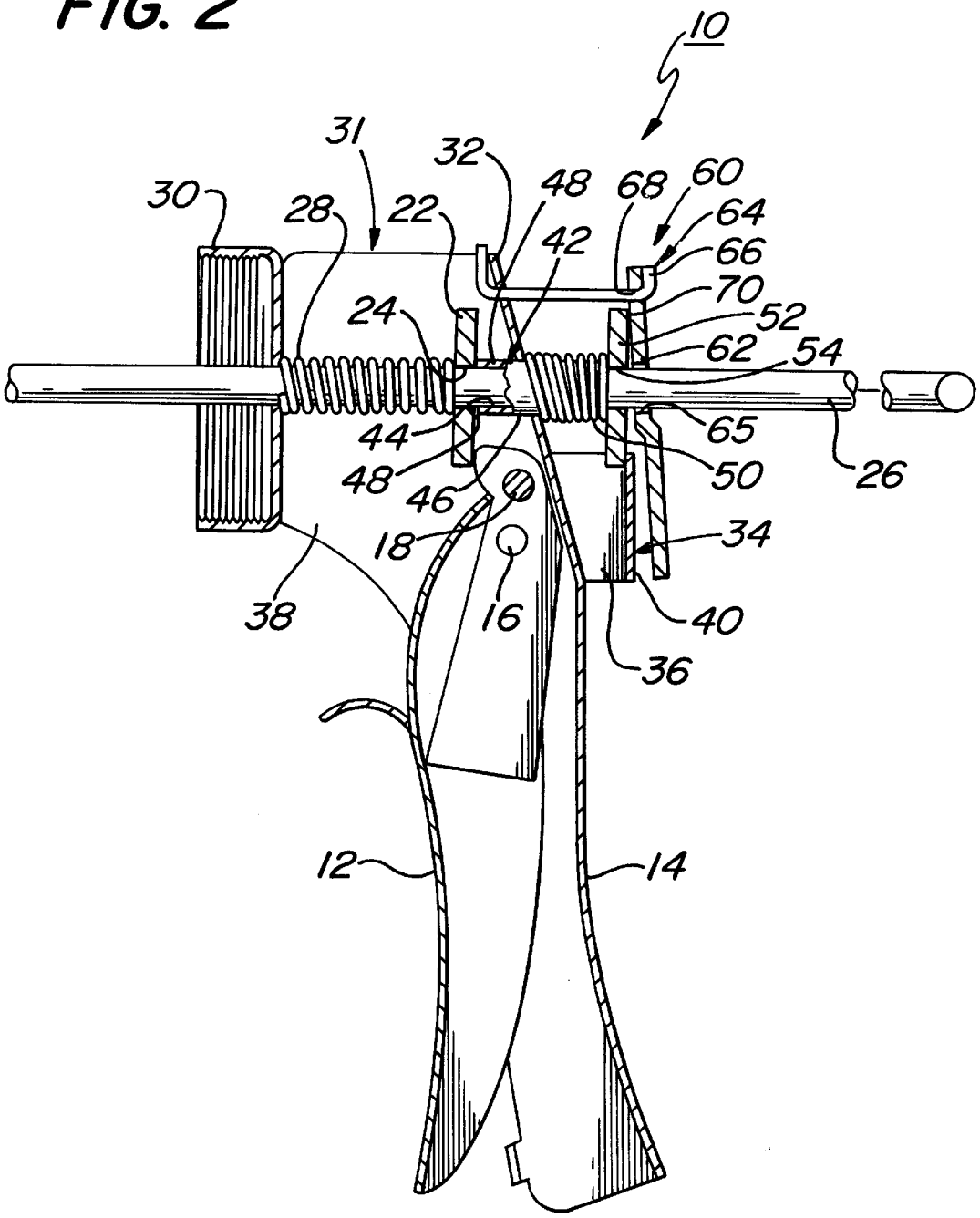
FIG. 2 is a sectional view of the proximal end of a caulking gun employing the unique high thrust drive system of the present invention after the trigger has been actuated to dispense a fluid, and with the recoil assembly thereof being shown prior to being actuated to release the gripping force on the piston rod passing therethrough.

As can be seen in FIGS. 1–3, movement of the gripping plate 22 in a distal direction maintains the gripping plate canted in a clockwise direction, and is against the biasing force of a coil spring 28 disposed about the piston rod 26 between proximal end cap 30 of the forward end of the gun, and the distal side of gripping plate. The proximal end cap 30 cooperates with a distal end cap (not shown) to support the container of material to be dispensed, all as is fully disclosed in my '831 patent, the subject matter of which already has been incorporated by reference into this application.

Referring to the Figures, the gripping plate 22 and the coil spring 28 are retained within an outer housing 31, with the piston rod 26 extending rearwardly through rear wall 32 of said housing. A generally U-shaped, sheet metal handle extension 34 includes opposed, laterally spaced-apart side walls 36 that are welded to outer side walls 38 of the housing 31, and a rear, or bridging wall 40 between said spaced-apart side walls.

As can be seen best in FIGS. 1 and 2, a tubular, cylindrical member 42 includes a generally cylindrical passage 44 through which the piston rod 26 extends, and a generally cylindrical outer periphery 46. The tubular member has a distal end 48 disposed in the interior of the outer housing 31, and is adapted to be maintained in engagement with the proximal surface of the gripping plate 22 through the action of the coil spring 28 prior to actuation of the trigger 12, but with the gripping plate maintained in a canted position (i.e., clockwise as viewed in FIGS. 1 and 2) clamped to the piston rod 26.

As is clearly seen in FIGS. 1–3, a coil spring 50 is disposed over the outer periphery of the tubular member 42, and is positioned between the rear wall 32 of the outer housing 30 and the distal surface of a recoil plate 52. The recoil plate 52 includes a passage 54 through which the piston rod 26 extends.

As is illustrated in FIGS. 1 and 2, the coil spring 50 cooperates with the upper region of the bridging wall 40 of the generally U-shaped, sheet metal handle extension 34 to normally bias the recoil plate 52 into a clockwise canted position as viewed in FIGS. 1 and 2. This causes edges defining the passage 54 of the recoil plate 52 to clamp onto, or grip, the piston rod 26 while imposing a torque on said piston rod in the same clockwise rotational direction as the torque imposed on the piston rod by the gripping plate 22 during the piston-driving stroke of the trigger 14. This torque prevents rearward movement of the piston rod 26 through the passage 54 in said recoil plate when the trigger 12 is released after a dispensing stroke. However, in this normally biased condition of the recoil plate 52, the piston rod 26 can move forwardly through the passage 54, in a distal direction, when the trigger 12 is actuated to move the gripping plate 22 forwardly, as is shown in FIG. 2. Thus, with the recoil plate 52 maintained in its normally biased, canted orientation, to impose a clockwise rotational torque on said piston rod, repeated actuation of the trigger 12 will incrementally advance the piston rod 26 and the piston (not shown) attached thereto in a distal direction to the left, as viewed in the Figures, to dispense a caulking or other high viscosity material.

Moreover, during the fluid dispensing stroke of the trigger 12 the driving force on the pivot rod 26 is created by engaging the gripping plate 22 adjacent a lower surface thereof. This cants the gripping plate 22 in a clockwise direction as viewed in FIGS. 1 and 2 to impart both a linear force and clockwise rotational torque on the piston rod during the fluid dispensing stroke. Upon release of the trigger 12 the clockwise torque imposed on the piston rod 26 by the gripping plate 22 is released to permit the gripping plate to slide relative to the piston rod in a rear direction under the influence of the coil spring 28. However, during this return stroke of the trigger 12, the recoil plate 52, by virtue of being canted in a clockwise direction as shown in FIGS. 1 and 2, continues to maintain a clockwise rotational torque on the piston rod 26 to preclude rearward movement of the piston rod.

Thus, in accordance with this invention, forces imposed on the piston rod 26 by the gripping plate 22 and recoil plate 52 impart a torque on the piston rod 26 in the same rotational direction during both the dispensing and return strokes of the trigger 12, thereby providing for a smooth linear motion of the piston rod during the dispensing strokes thereof. This is in distinction to prior art devices in which the arrangement in which the gripping plate and recoil plate engage the piston rod imposes torques in opposite rotational directions on said piston rod during the fluid delivery strokes and return strokes of the trigger, respectively.

After the material is dispensed by the gun 10, or when it is desired to change the material to be dispensed, it is necessary to retract the piston rod 26 by moving it to the right, as viewed in the Figures. However, in order to permit this movement to take place it is necessary to move both the gripping plate 22 and the recoil plate 52 in a counterclockwise direction out of their normally clockwise canted positions in which they clamp onto the piston rod 26, and into a neutral position, which releases the clamping action on the piston rod for permitting the piston rod to be retracted to the right through passages 24 and 54 in said gripping plate and recoil plate, respectively, as viewed in FIGS. 1 through 3.

In order to release the clamping action on the piston rod 26 by both the gripping plate 22 and the recoil plate 52, the present invention includes a unique recoil system 60 for establishing a mechanical advantage to move the recoil plate 52 and the gripping plate 22 into their required neutral position to release their grip on the piston rod 26, and thereby permit the piston rod to be moved to the right, as viewed in the Figures.

Specifically, the recoil system 60 is a unique double lever arrangement wherein the recoil plate 52 itself constitutes one of the levers. The other lever 62 is located to the right, or proximally of the recoil plate 52 and is pivotally secured to the gun 10 on a generally U-shaped bracket, or recoil link 64 connected through the rear wall 32 of the outer housing 31 and having an upturned leg 66 at the proximal end thereof for being received within passage 68 disposed at the upper end of the lever 62. The lever 62 includes an enlarged passage 65 therein through which the piston rod 26 is received loosely. In other words, edges of the passage 65 do not grip or clamp onto the piston rod 26 to impair movement of the piston rod relative to the lever.

The lever 62 is arranged such that in its normal position, prior to being actuated to move the recoil plate 52 into a neutral position, it engages the recoil plate at 70, adjacent the upper edge of said plate and at a location spaced from the passage 54 of the recoil plate through which the piston rod 24 extends. (See FIGS. 1 and 2).

In operation of the recoil system 60, the lever 62 is engaged by a user of the gun in a region adjacent a lower edge thereof, remote from the pivotal connection of the lever to the generally U-shaped recoil link 64, and is pivoted in a clockwise direction, as viewed in FIGS. 1–4. The section of the lever 62 between the point at which it is engaged by the user of the gun and the region 70 at which it engages the recoil plate 52 constitutes a lever arm that provides a mechanical advantage. Moreover, the section of the recoil plate 52 between its point of engagement 70 with the lever 62 and the axis of the passage 54 through the recoil plate 52 constitutes a second lever arm that enhances the mechanical advantage for pivoting the recoil plate in a counterclockwise direction about the piston rod 26 into a neutral position, as shown in FIG. 3. Movement of the recoil plate 52 in a counterclockwise direction into its neutral position moves the tubular member 42 against the proximal side of the gripping plate 22 to also move said gripping plate in a counterclockwise direction into a neutral position in which the gripping plate disengages its gripping action on the piston rod 26, as also shown in FIG. 3.

The recoil system 60 of this invention is usable in a variety of different dispensing devices, including ones wherein it is not necessary to simultaneously release a gripping or driving plate with the release of the recoil plate. It should be noted that, in addition to the mechanical advantage created by the recoil system 60 of this invention, the recoil system is designed to cooperate with the gripping plate 22 to impose torques on the piston rod 26 in the same rotational direction, both during the dispensing stroke of the trigger 12 and the return stroke of said trigger. This enhances the smoothness of the linear movement of the piston rod 26 during the fluid dispensing stroke of the trigger and also minimizes the wear placed on the system, as compared to prior art devices in which the torques are in opposite rotational directions.

Although the unique high thrust drive system of this invention has been shown incorporated into a unique, high thrust dispensing device particularly adapted for the dispensing of high viscosity fluids, such as caulking compounds, the drive system can be used in a variety of other devices to provide a variety of different functions in which high thrust is desired. For example, the drive system of his invention can be employed in devices for jacking, clamping and lifting articles.

Without further elaboration, the foregoing will so fully illustrate my invention that others may, by applying current or future knowledge, adopt the same for use under various conditions of service.

What I claim as my invention is:

1. A high thrust drive system including a driving rod member, an actuating member including a trigger mounted for movement about a pivot axle and including a gripping section spaced from the pivot axle for engagement by a user's hand to move said trigger about said pivot axle through a driving stroke and a return stroke, said gripping section of said trigger being disposed adjacent to and forwardly of a handle that is engageable by the user's hand employed to move the trigger, a gripping plate having a passage therein through which the driving rod extends for gripping the driving rod and moving said rod in a forward, thrust-applying direction during the driving stroke of the trigger, said trigger including a section that is spaced from the gripping section for engaging the gripping plate to impose a high thrust on the driving rod member through the gripping plate during the driving stroke of said trigger, said gripping plate imposing a torque on said driving rod member in a first rotational direction as said trigger is moved through the driving stroke, a recoil plate positioned rearwardly of the gripping plate having a passage through which said driving rod extends, said recoil plate being oriented to grip the driving rod adjacent the passage through the recoil plate during the return stroke of the trigger and impose a torque on said driving rod in said first rotational direction to preclude movement of said driving rod in a rearward direction opposite said thrust-applying direction, a lever positioned adjacent and rearward of both said recoil plate and said handle for engagement by the user's hand at a first location, said lever being engageable with said recoil plate at a second location spaced from both the passage through said recoil plate and said first location, said lever being mounted at a third location for pivotal movement, said second location being disposed between said first and third locations, whereby when the user's hand engages said lever at said first location and pivots the first location of said lever in a forward direction toward the handle said recoil plate is moved into an orientation for releasing the grip of said recoil plate from said driving rod to permit said driving rod to be moved manually in the rearward direction opposite the thrust-applying direction.

2. The high thrust drive system of claim 1, wherein said gripping plate is canted in a first direction relative to said driving rod during the driving stroke of said actuating member and wherein said recoil plate normally is canted in said first direction during both the driving and return strokes of said actuating member.

3. The high thrust drive system of claim 1, wherein said recoil plate engages a wall member at a location on the side of said passage through said recoil plate opposite the second location.

4. A dispensing device for fluids including a trigger movable through a dispensing stroke and a return stroke about a pivot axle, said trigger including a gripping section spaced from the pivot axle for engagement by a user's hand to move said trigger about said pivot axle, a piston rod, a gripping plate having a passage therein through which the piston rod extends for gripping the piston rod and moving said piston rod in a forward, fluid dispensing direction during the dispensing stroke of the trigger, said gripping plate imposing a torque on said piston rod in a first rotational direction during the dispensing stroke of the trigger, a recoil plate having a passage through which said piston rod extends for gripping the piston rod during the return stroke of the trigger and imposing a torque on said piston rod in said first rotational direction to preclude movement of said piston rod in a rearward linear direction opposite said fluid dispensing direction, a lever positioned adjacent and rearward of both said recoil plate and said trigger for engagement by the user's hand at a first location, said lever being engageable with said recoil plate at a second location spaced from both the passage through said recoil plate and said first location, said lever being mounted at a third location for pivotal movement, said second location being disposed between said first and third locations, whereby when the user's hand engages said lever at said first location and pivots the first location of said lever in a forward direction toward the trigger said recoil plate is moved into an orientation for releasing the grip of said recoil plate from said piston rod to permit said piston rod to be moved manually in the rearward direction opposite said fluid dispensing direction.

5. The dispensing device of claim 4, wherein said gripping plate is canted in a first direction relative to said piston rod axis during the dispensing stroke of said trigger and wherein said recoil plate normally is canted in said first direction during both the dispensing and the return strokes of said trigger.

6. The dispensing device of claim 4, wherein said recoil plate engages a wall of said device at a location on the side of said passage through said recoil plate opposite the second location.

7. A dispensing device for fluids including a piston rod, a gripping plate having a passage therein through which the piston rod extends for gripping the piston rod and moving it in a forward, fluid dispensing direction, characterized in that the device includes a recoil system located rearwardly of the gripping plate, said recoil system being in the form of a double lever, one of said levers being a recoil plate including a passage through which the piston rod extends and the other of said levers having one end pivotally secured to said device and a second end for engagement by a user for moving said second end in a forward direction, said other of said levers, when moved in the forward direction, engaging with said recoil plate in a location spaced from the passage through said recoil plate between said one end and said second end of the other of said levers.

8. The dispensing device of claim 7, wherein said location in which the other of said levers engages the recoil plate is adjacent to the end of said other of said levers that is pivotally secured to said device.

* * * * *